US007425153B1

(12) United States Patent
Miller

(10) Patent No.: US 7,425,153 B1
(45) Date of Patent: Sep. 16, 2008

(54) ELECTRONIC CONNECTOR

(75) Inventor: Robert O. Miller, Deer Park, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 11/903,867

(22) Filed: Sep. 25, 2007

(51) Int. Cl.
*H01R 9/05* (2006.01)

(52) U.S. Cl. ..... 439/578; 439/675; 439/669

(58) Field of Classification Search ..... 439/578, 439/669, 675
See application file for complete search history.

(56) References Cited

U.S. PATENT DOCUMENTS

| | | | | |
|---|---|---|---|---|
| 3,671,922 | A * | 6/1972 | Zerlin et al. | 439/352 |
| 3,706,958 | A | 12/1972 | Blanchenot | 339/177 E |
| 4,444,453 | A | 4/1984 | Kirby et al. | 339/177 R |
| 4,687,279 | A * | 8/1987 | Holland et al. | 439/578 |
| 5,439,386 | A * | 8/1995 | Ellis et al. | 439/322 |
| 5,518,420 | A * | 5/1996 | Pitschi | 439/578 |
| 5,651,698 | A * | 7/1997 | Locati et al. | 439/578 |
| 6,468,089 | B1 | 10/2002 | Hubbard et al. | 439/63 |
| 6,575,784 | B1 * | 6/2003 | Yamada | 439/578 |
| 6,780,051 | B2 | 8/2004 | Otsu | 439/578 |
| 2006/0246774 | A1 | 11/2006 | Buck | 439/578 |

OTHER PUBLICATIONS

PCT Notification of Transmittal of the International Search Report and the Written Opinion of the International Searching Authority including the International Search Report and Written Opinion.

* cited by examiner

*Primary Examiner*—Truc T Nguyen
(74) *Attorney, Agent, or Firm*—Alix, Yale & Ristas, LLP

(57) ABSTRACT

A connector for a coaxial cable including a base member having forward and rearward ends and a central bore into which the cable is inserted. A stop is provided in the bore for limiting the insertion of the cable. A transverse screw secures the cable in the bore when at the stop. A housing having forward and rearward ends surrounds a plug connector. The plug connector includes a signal conductor having a needle like projection extending rearward and a ground contact insulated from the signal conductor and including a knife edge projection extending rearward. The housing and base member are threadably connected to each other so that as they are drawn together during assembly, the needle-like projection and the knife edge projection extend into the bore of the base member rearward of the stop and engage the coaxial cable in the bore of the base member.

20 Claims, 6 Drawing Sheets

ELECTRONIC CONNECTOR

FIELD OF INVENTION

This invention relates generally to electronic connectors, more particularly, to electronic plug connectors for connecting coaxial cable to electrical devices.

BACKGROUND

Many types of electrical connectors for connecting coaxial cable to electrical devices are known. Examples of such connectors are shown in U.S. Pat. Nos. 6,533,617, 6,568,964, and 6,729,912 to D'Addario. The disclosure for each of these patents is incorporated herein by reference in its entirety.

The type of connector of present interest would be sold at retail as a standalone item or in a kit with a coaxial cable, such that the purchaser would trim a coaxial cable to a desired length and then attach the connector. As shown in these patents, the connector may include a base having a central probe member and a bushing with a knife edge positioned in the base. A coaxial cable is cut by the user and inserted into the plug body so that the central probe and knife edge on the bushing extend into the front end of the cable. The coaxial cable is secured in the plug body by a transverse screw that partially penetrates the cable.

Generally, if this operation is performed correctly, the system is very effective and reliable. However, if not performed correctly, it can yield intermittent and defective conditions. If the user does not cut the wire cleanly or does not insert the wire all the way into the plug body, a faulty connection can result. Additionally, stray braid wires from the cutting of the cable may come into contact with the center pin connection and create a short.

The present connectors do not provide sufficient visual feedback during assembly to confirm to the user that the cable has been inserted fully and properly into the connector and that there are no stray braid wires. Accordingly, it is desirable that a plug connector be provided wherein the user can ascertain if the cable has been properly inserted into the connecter and wherein the proper pin connection is automatically made when the connector is fully assembled.

SUMMARY OF THE INVENTION

In general, this objective is achieved by securing the leading end of a transversely cut coaxial cable against a stop in the bore of a base member, and drawing and securing a distinct plug member and associated housing coaxially toward the base member such that a central signal pin and a knife-like ground contact associated with the plug member, coaxially penetrate the central conductor wire and the outer ground conductor of the cable.

The user can observe and confirm the condition and position of the cut cable as secured in the base member, before initiating the next step of coaxially aligning the housing and associated plug with the base member and associated cable. The housing and base member have means, such as internal and external threads, for drawing them together to a finally assembled condition, and thus driving the pin and knife associated with the plug, into the respective conductors of the cable over a known penetration distance.

Another advantage is that a common base member can be employed with a variety of plug members having a common configuration of the associated pin and knife projection. The housings and connections of the plugs to the housings need not be uniform, so long as the housings have a common way of fully connecting to the base member. In this way, a kit having a cable and connectors need only include one base member for each end of the cable, and a variety of plug members with associated housing.

One apparatus embodiment includes a base member having forward and rearward ends and a central bore into which the cable is inserted. A stop is provided in the bore for limiting the insertion of the cable. A transverse screw secures the cable in the bore when at the stop. A housing having forward and rearward ends surrounds a plug connector. The plug connector includes a signal conductor having a needle like projection extending rearward and a ground contact insulated from the signal conductor and including a knife edge projection extending rearward. The housing and base member are threadably connected to each other so that as they are drawn together during assembly, the needle-like projection and the knife edge projection extend into the bore of the base member rearward of the stop and engage the coaxial cable in the bore of the base member.

According to another aspect there is provided an electronic connector for a coaxial cable comprising a base member having forward and rearward ends, a central bore extending there through and adapted to have a coaxial cable inserted into the bore from the rearward end thereof. A stop is provided in the bore for limiting the insertion of the cable into the bore. Means are provided for securing a cable in the bore. A housing having forward and rearward ends is provided. A plug connector is contained in the housing. The plug connector includes a signal conductor having a needle-like projection extending rearward and a ground contact insulated from the signal conductor and including a knife edge projection extending rearward. Means are provided for advancing the housing and base member toward each other so that the needle-like projection and the knife edge projection extend into the bore of the base member rearward of the stop and secure the housing and base member together.

According to yet another aspect there is provided a connector on a coaxial cable having a central signal conductor, an insulating layer around the signal conductor, a substantially tubular ground conductor around the insulating layer, and an insulating outer sheath, wherein the cable has a leading end with a clean transverse cut, comprising a base member having forward and rearward ends, a central bore extending between the forward and rearward ends, and a stop in the bore adjacent the forward end. The coaxial cable is inserted through the rearward end such that the leading end of the cable confronts the stop at the forward end, the stop defining a predetermined limit position of the leading end of the inserted cable, means is provided for securing the cable in the bore with the leading at the position. A housing is provided having forward and rearward ends. A plug connector is contained in the housing. The plug connector includes a signal conductor having a rearward extending needle-like projection and a ground contact insulated from the signal conductor and including a rearward extending knife edge projection. The forward end of the base member is attached to the rearward end of the housing with the needle-like projection axially penetrating the leading end of the coaxial cable in conductive contact with the signal conductor of the cable and the rearward extending knife edge projection coaxially penetrating the leading end of the cable between the sheath and the insulating layer and in conductive contact with the ground conductor of the cable.

According to a further aspect there is provided a method of joining a connector to a coaxial cable having a central signal conductor, an insulating layer around the signal conductor, a substantially tubular ground conductor around the insulating layer, and an insulating outer sheath, comprising cutting the cable transversely to form a leading end having substantially coplanar central signal conductor, insulating layer, ground conductor, and sheath; inserting the leading end of the cable into a base member to a stop that defines a predetermined limit position of the leading end relative to the base member and securing the cable within the base member at the limit position to form a first assembly; providing a second assembly comprising a housing member having a plug connector contained therein including a signal conductor mounted therein including a needle like projection extending rearward and a ground contact insulated from the signal conductor and including a knife edge projection extending rearward; and drawing the first and second assemblies coaxially toward each other to a fully assembled condition wherein the needle-like projection axially penetrates the leading end of the cable and establishes conductive contact with the signal conductor of the cable and the knife edge coaxially penetrates the leading end of the cable between the sheath and the insulating layer and establishes conductive contact with the ground conductor of the cable.

DETAILED DESCRIPTION

Figure 1:
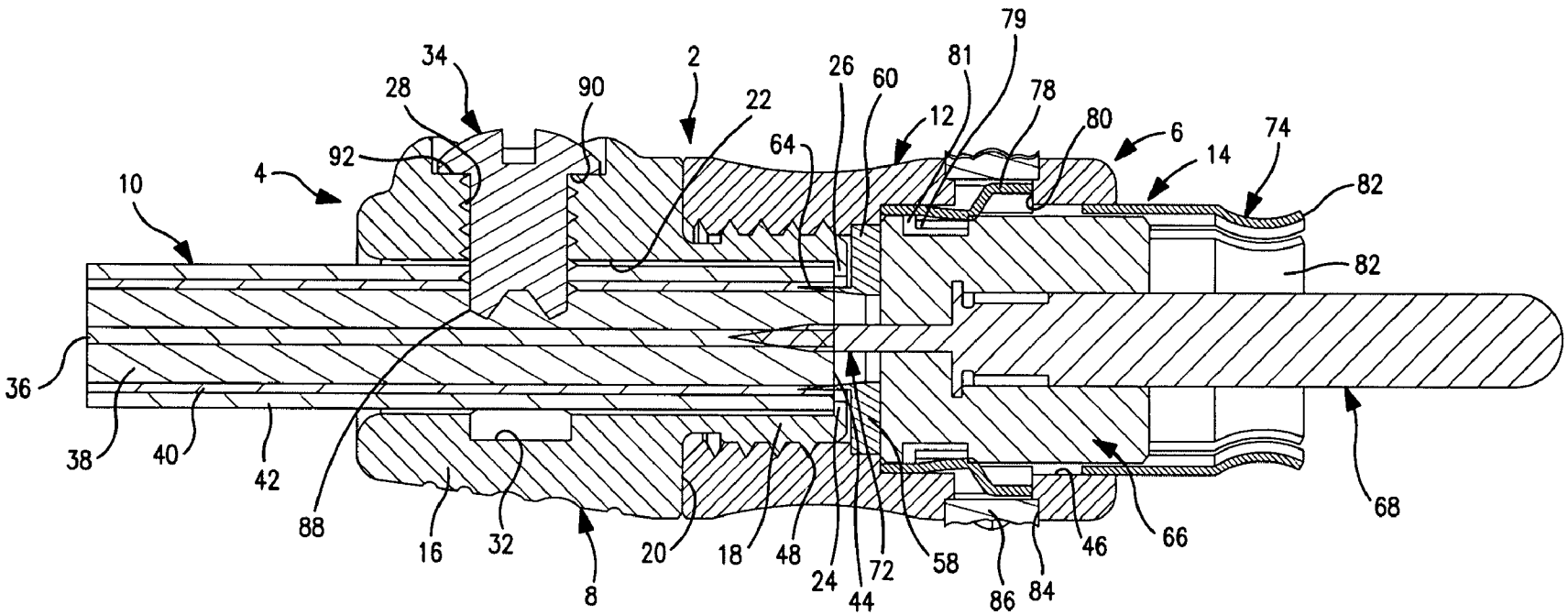
FIG. 1 is a sectional side view of an electronic connector showing a coaxial cable mounted therein.

Referring to the drawings, and particularly FIG. 1, the electronic connector 2 includes generally a rear assembly 4 and a forward assembly 6. The rear assembly 4 includes a base member 8 in which a coaxial cable 10 is mounted. The forward assembly 6 includes a housing 12 in which a connector plug 14 is mounted and which is removeably connected to the base member 8.

More specifically, the base member 8 includes an enlarged rear portion 16 and a reduced cylindrical threaded forward portion 18 which forms a forward facing shoulder 20 with the rear portion 16. A central bore 22 extends axially through the base member 8 and has a rearward facing stop 24 therein formed by a circular inturned flange 26 at the forward end of the reduced forward portion 18.

A threaded bore 28 extends through the sidewall 30 of the base member 8 in a direction perpendicular axis of the bore 22 there through. A bore 32 extends into the internal surface of the sidewall across from the bore 28 and is coaxial therewith. A screw member 34 is threaded into the bore 28 and is dimensioned to extend into the central bore 22 of the base member 8 to engage the coaxial cable 10 to secure the cable 10 within the base member 8. The screw member 34 may be suitable type of screw such as a pan head screw as shown in FIG. 1 or a set screw or round head screw.

As is conventional, the coaxial cable 10 may comprise a central signal wire or conductor 36 surrounded by a dielectric or insulation layer 38. A tubular ground connector in the form of a ground braid 40 is interposed between the insulation layer 38 and an outer jacket 42. When the coaxial cable 10 is mounted within the central bore 22 in the base member 8, its forward end 44 abuts against the stop 24 and the screw member 34 is tightened to secure the coaxial cable 10 within the base member 8.

Figure 3:
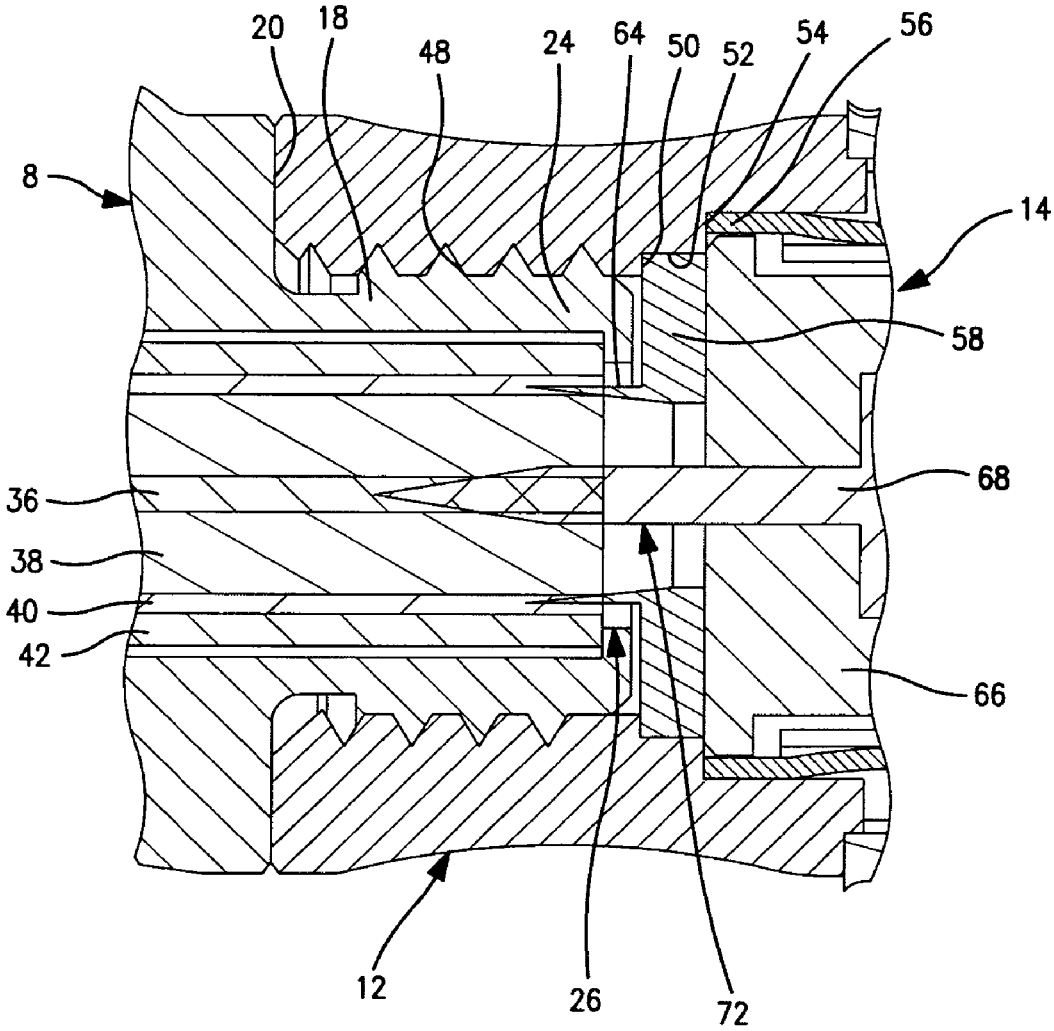
FIG. 3 is an enlarged sectional view of the interface between the base member and housing of the connector.

The housing 12 of the forward portion 6 includes a bore 46 extending therethrough having a rearward threaded portion 48 of a reduced internal diameter. As shown in FIG. 3, a first shoulder 50 is formed immediately forward of the threaded portion 48 by an enlarged diameter portion 52. A second shoulder 54 is formed forward of the first shoulder 50 by a larger diameter portion 56 as shown.

Figure 4:
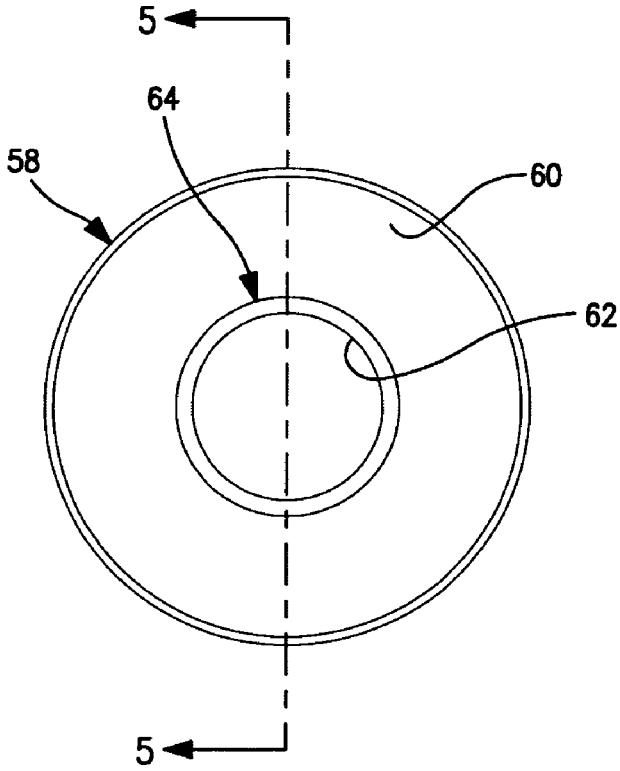
FIG. 4 is a rear view of the ground contact.
Figure 5:
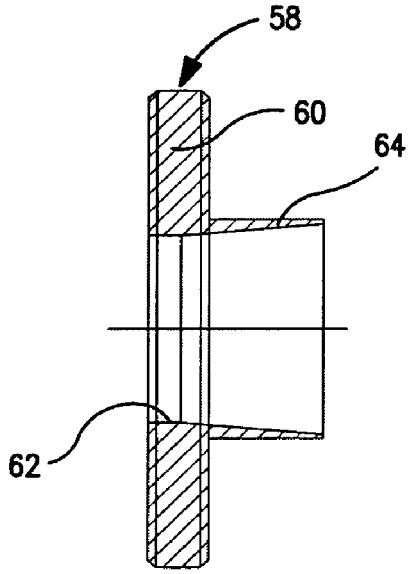
FIG. 5 is a sectional view of the ground contact taken along the lines 5-5 of FIG. 4.

The plug 14, of the RCA type, includes a ground contact 58 in the form of a cylindrical bushing 60 having a bore 62 therethrough (See FIGS. 4 and 5) with a circular knife edge 64 extending rearward therefrom that comes to a sharp point at its rearward most end. The bushing 60 is positioned in the enlarged diameter portion 52 of the bore 46 against the first shoulder 50. The knife edge 64 extends into the central bore 22 of the threaded forward portion 22 of the base member 8 in a position to slide between the cable jacket 42 and ground braid 40 of the coaxial cable 10 when the coaxial cable 10 is inserted into the base member 8 and the housing 12 is threaded onto the base member 8.

A cylindrical insulating ring 66 is provided in the forward end of the housing 12 and has its rearward end positioned against the second shoulder 54 in the bore 46. A pin or probe member 68 forming a signal conductor is contained in the insulating ring 66 and extends from the forward end thereof as shown with a rounded tip 70 at its free end. A short needle-like portion 72 having a sharp pointed end is provided at the other end of the pin or probe member 68. The needle-like portion 72 extends into the central bore 22 in the base member 8 in a position to penetrate the cable 10 and make contact with the central single wire or conductor 36 thereof when the housing 12 is threaded onto the base member 8.

Figure 2:
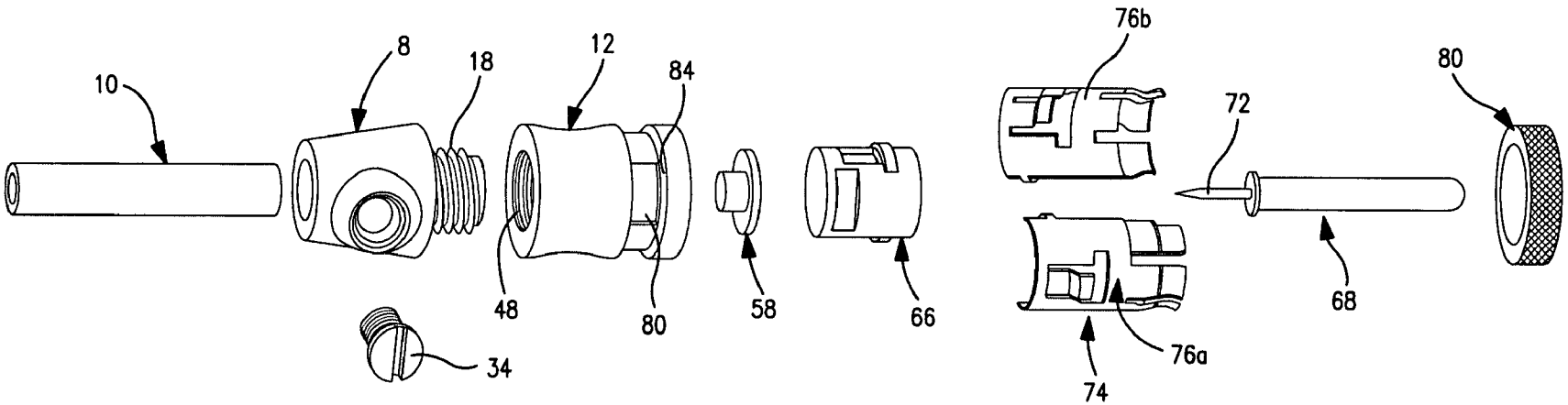
FIG. 2 is an exploded side view of the various components of the connector of FIG. 1.

A conducting ground sleeve 74 surrounds the insulating ring 66. The ground sleeve 74 may be formed from two mating half shells 76*a* and 76*b* (See FIG. 2) that extend from the second shoulder 54 in the housing 12 forwardly out of the housing 12 to a point short of the tip 70 of the pin or probe member 68. Each half shell 76*a* and 76*b* includes raised tabs 78 which extend into openings 80 in the interior wall of the housing 12 and detents 79 which extend into a recess 81 in the insulating ring 66. The tabs 78 serve to secure the ground sleeve 74 within the housing 12 which in turn secures the insulating ring 66 by virtue of the detents 79. The insulating ring 66 in turn holds the bushing 60 of the ground contact r8 in the bore portion 52 in the housing 12.

The insulating ring 66 may be comprised of molded plastic material such as a molded thermoplastic, e.g., acetyl resin, nylon ABS resin or blends thereof. The conductive pin or probe member 68 may be insert molded within the insulating ring 66. The ground sleeve 74 may be formed from conductive sheet stock. The insulating ring 66 serves to electrically separate the ground sleeve 74 from the pin or probe member 68, both of which are conductive.

The ground sleeve 74 also includes a plurality of spaced apart spring fingers 82 which are adapted to provide an inward force against the collar of a jack connector (not shown) when the plug connector 14 is installed on the jack connector. A circular recess 84 is provided around the outer circumference of the housing 12 that communicates with the openings 80 that receive the tabs 78 of the ground sleeve 74. A color coded elastomeric ring member 86 is positioned within the recess 84 and covers the tabs 78.

With the above arrangement, the electrical connector 2 is provided in the form of two assemblies, the first being the base member 8 in which the end of the coaxial cable is secured. The second assembly is the housing 12 that contains the connector plug 14. The two assemblies are adapted to be advanced toward each other and secured together so the plug 14 is connected to the coaxial cable.

In use, with the arrangement as described above, the coaxial cable 10 has its forward end cleanly cut at substantially right angles to its axis. The screw member 34 is withdrawn so it does not protrude into the bore 22 and the forward end of the coaxial cable is inserted into the rearward end of the bore 22 of the base member 8. The coaxial cable 10 is inserted into the base member 8 until its forward end abuts against the stop 24 at the forward end of the bore 22 of the base member 8. With the coaxial cable 10 firmly seated with its forward end against the stop 24, the screw member 34 may be threaded into the base member 8 so that its inner knife edge 88 penetrates through the outer jacket 42 and ground braid 40 of the coaxial cable 10. The screw member 34 is so dimensioned that its maximum travel of the set screw, dictated by the shoulder 90 engaging the counter bore 92, is such that the screw member 34, while making contact with the ground braid 40 of the coaxial cable 10, is limited so that damage to the coaxial cable 10 is prevented. This dimension ensures that good contact is made with the coaxial cable 10 and particularly the ground braid 40, with no significant risk of damaging the coaxial cable.

As the base member 8 with the coaxial cable 10 inserted therein is a separate assembly from the housing and plug assembly, the forward end of the cable is visible through the forward end of the base member 8. It should be noted that the inturned flange forming the stop 24 is of a dimension such that its inner diameter is substantially equal to, or slightly greater than the inner diameter of the outer jacket 42 of the coaxial cable 10. This results in the ground braid 40, insulating layer 38 and central single conductor 36 being visible through the forward end of the base member 8 when the housing 12 is unattached. At this point, the forward end of the coaxial cable 10 can be inspected to be sure that it is seated properly against the stop 42 and nothing is present, such as a loose end or strand of the braiding or shielding, which could possibly cause a short.

With the coaxial cable 10 secured in the base member 8 as described above, the two assemblies can be connected. The rearward threaded portion 48 of the housing 12 is threaded onto the reduced threaded portion 18 of the base member 8 drawing the housing and base member toward each other. As the two parts are threaded together, the needlelike portion 72 of the pin or probe member 18 is forced to penetrate the central signal wire 36 of the coaxial cable 10. At the same time, the knife edge of the ground contact 58 enters the end of the coaxial cable 10 between the outer jacket 42 and the ground braid 40 providing connection between the ground contacts. When the housing 12 and base member 8 are fully threaded on to one another so that the rearward end of the housing 12 abuts the shoulder 20 on the base member 8, proper electrical connections have been made.

A positive connection is provided from the central signal wire or conductor 36 through the needlelike portion 72 to the probe member 68. The ground connection is provided from the ground braid 40 of the coaxial cable 10 through the knife edge 64 of the ground contact 58 and housing 12 to the ground sleeve 74 and spring fingers 82.

With the embodiment shown in FIGS. 1-5, the screw member 34 serves as a redundant ground contact. The screw member 34, when tightened, is in contact with the ground braid 40 of the coaxial cable 10. A ground connection is provided from the screw member 34, through the base member 8 and housing 12 to the ground sleeve 74 which is in contact with the housing 12.

Figure 6:
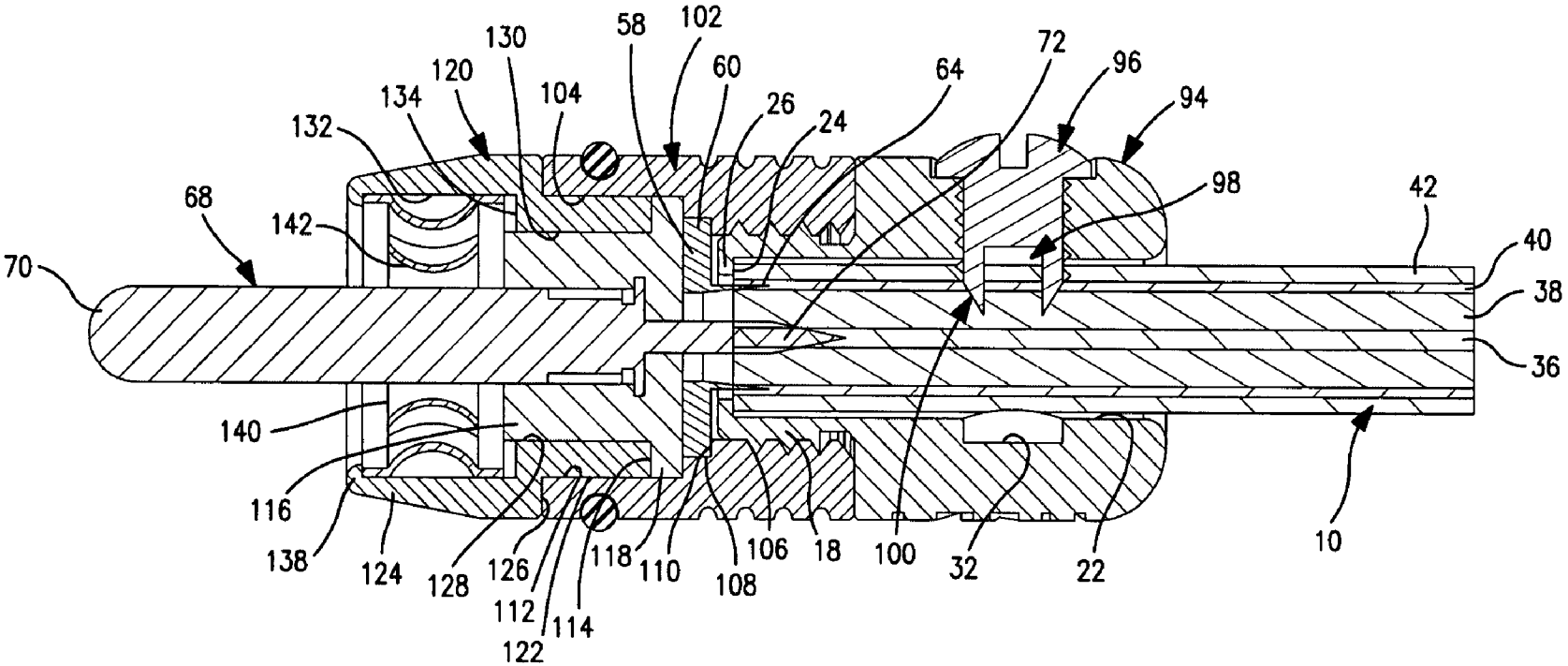
FIG. 6 is a sectional view of a second embodiment of an electronic connector.

Another embodiment of an RCA type plug that may be used in connection with the connector is shown in FIG. 6. In this embodiment the base member 94 which receives the coaxial cable 10 may be the same as that described with FIGS. 1-5. However, as shown in FIG. 6, the screw member 96 that secures the coaxial cable 10 may be of the type shown and described in copending application Ser. No. 11/788,945 filed on Apr. 23, 2007, the disclosure of which is incorporated herein by reference in its entirety. As described more fully in that application, the screw 96 may be provided with a pocket 98 and a knife edge 100 at its inner end so that when it is threaded into the housing, and into the side of the coaxial cable, the knife edge 100 cuts a plug out of the coaxial cable 10 which is received up into the pocket 98. This type of screw may be used in the embodiment of FIGS. 1-5 if desired. Otherwise the base member 96 is the same as that described in connection with the embodiment of FIGS. 1-6 and includes the forward inturned flange 26 forming the stop 24 against which the end coaxial cable 10 abuts when inserted into the base 94.

In the embodiment of FIG. 6, a housing 102 includes an axially extending through bore 104 having a reduced threaded portion 106 at its rearward end which is adapted to be threaded onto the threaded forward portion 18 of the base member 94. The bore 104 also includes an intermediate larger portion 108 forming a first shoulder 110 with the reduced portion 106 and a large forward portion 112 forming a second shoulder 114 with the intermediate portion 108. A ground contact 58, similar to that shown in connection with FIGS. 1-5, positioned in the bore 104. The bushing 60 of the ground contact 58 is positioned against the first shoulder 110 with the rearward extending knife edge 64 extending into the central bore 22 of the base member 94 in engagement with the ground raid 40 of the coaxial 10 when the housing 102 and base member 94 are attached to each other.

An insulating ring 116 having a flange 118 at its rearward end is positioned in the bore 104 of the housing 102 with the rearward face of the flange 118 positioned against the bushing 60 of the ground contact 58 and the second shoulder 114. A pin or probe member 68 like that shown in connection with the embodiment of FIGS. 1-5 is insert molded in the insulating ring 116 and includes a rearward extending needle-like projection 72 and a forward extending male probe member having a rounded tip portion 70.

A ground sleeve 120 includes a reduced rearward cylindrical outer surface 122 positioned within the housing 102 and an enlarged forward outer surface 124 which extends from the housing 102 and which forms a shoulder 126 with the reduced portion 122. The ground sleeve 120 also includes a central bore 128 extending therethrough having a rearward reduced cylindrical portion 130 and an enlarged cylindrical forward portion 132 forming a rearward facing shoulder 134 with the reduced portion 130. The reduced cylindrical portion 130 of the bore 128 in the ground sleeve 120 has a diameter such that the rearward end of the ground sleeve 120 can be positioned over the outer cylindrical surface 136 of the insulating ring 116 as shown. The forward portion 132 of the bore 128 has an inturned flange 138 at the forward end. A circular spring member 140 having a plurality of circumferentially spaced, inwardly extending spring protrusions 142 is mounted in the enlarged portion 132 of the bore 128 between the shoulder 134 and the inturned flange 138.

In assembly, the ground contact 58 is inserted in the bore 104 of the housing 102 until the bushing 60 abuts the first shoulder 110 and the insulting ring 116 with the embedded probe or pin member 68 may then be inserted into the bore 104 until it abuts against the ground contact 58 and second shoulder 114. At this point, the ground sleeve 120 may be inserted into the forward end of the bore 104 of the housing 102. The diameter of the rearward cylindrical outer surface 122 of the ground sleeve 120 and the diameter of the large forward portion 112 of the bore 104 in the housing 102 are such that the rearward cylindrical outer surface 122 of the ground sleeve 120 has a press fit within the bore 104 of the housing 102. Thus by forcing the ground sleeve 120 into the forward end of the housing 102 until the shoulder 126 of the ground sleeve 120 abuts the forward end of the housing 102 and the rearward end of the ground sleeve 120 abuts the flange 118 on the insulating ring 116, a tight fit is achieved between the ground sleeve 120 and the housing 102 and the ground contact 58 and the insulating ring 116 are contained within the housing.

With the arrangement of FIG. 6, the coaxial cable 10 is secured in the base member 94 with it forward end in engagement with the stop 24 by the screw 96. As in the previous embodiment, the forward end of the coaxial cable will be able to be visually inspected through the forward opening in the base member 94. At this point, the housing 102 may be threaded onto the base member 94. As the two parts are threaded together, the needlelike portion 72 of the pin or probe member 18 is forced to penetrate the central signal wire 36 of the coaxial cable 10. At the same time, the knife edge of the ground contact 58 enters the end of the coaxial cable 10 between the outer jacket 42 and the ground braid 40 providing connection between the ground contacts. When the housing 102 and base member 94 are fully threaded onto each other so that the rearward end of the housing 12 abuts the shoulder 20 on the base member 94, proper electrical connections have been made.

Figure 7:
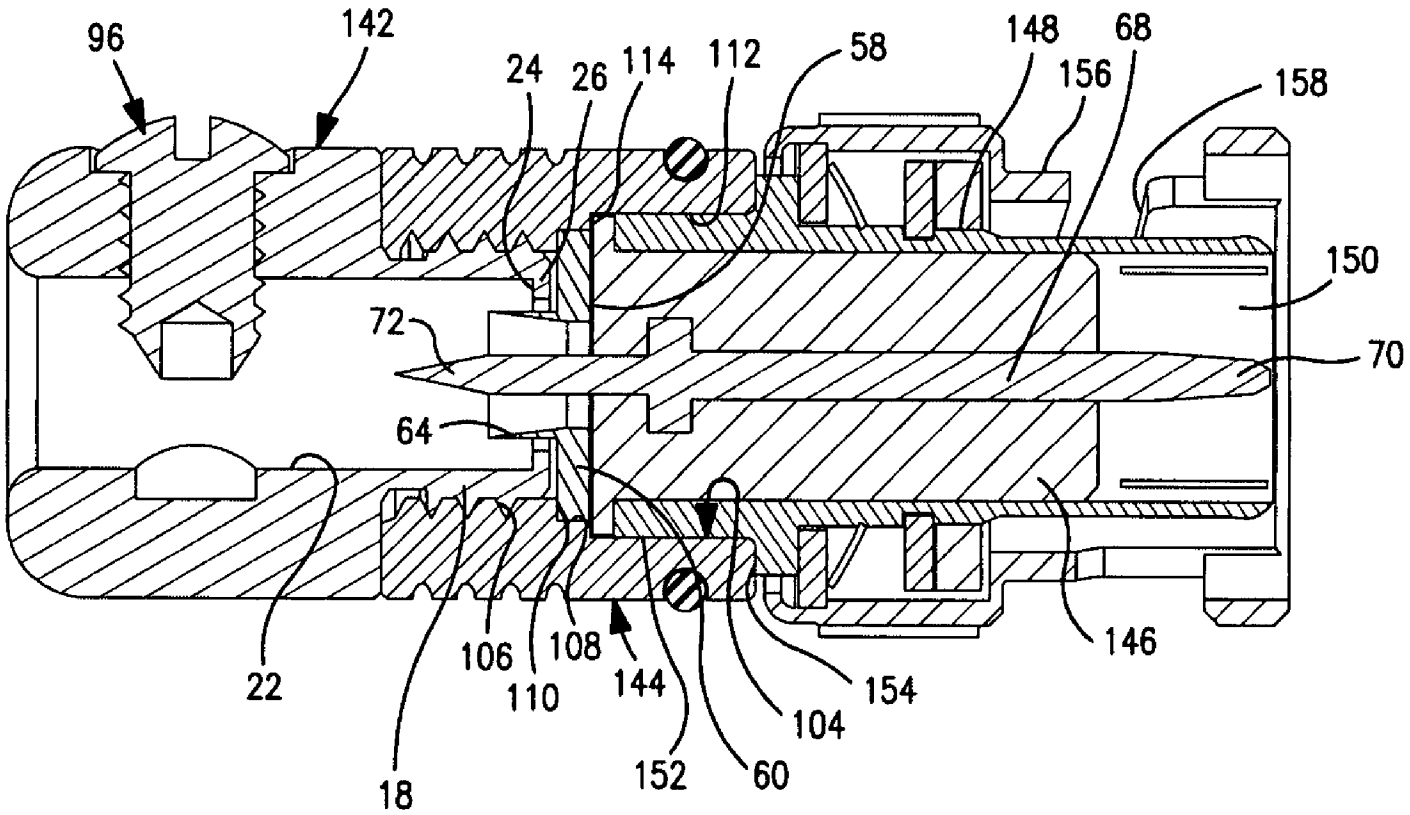
FIG. 7 is a sectional view of an alternative embodiment of the electronic connector showing a connector having a BNC plug, and with the coaxial cable omitted.

While FIGS. 1-6 show an RCA type connector plug, other types of connector plugs may be used. For example, FIG. 7 shows an embodiment which uses a BNC plug. In this embodiment, the base member 142 which receives the coaxial cable 10 may be the same as that described in connection with FIG. 6. As such, the base member 142 includes the forward inturned flange 26 in the forward end of the bore 22 forming the stop 24 against which the forward end of the coaxial cable 10 (not shown in FIG. 7) abuts when inserted into the base 142. Additionally, the base member 142 includes the screw member 96 for securing the coaxial cable within the bore 22 against the stop 24.

In the embodiment of FIG. 7, the housing 144 is the same as that described in connection with FIG. 6 and includes an axially extending through bore 104 having a reduced threaded portion 106 at its rearward end which is adapted to be threaded onto the threaded forward portion 18 of the base member 142. The bore 104 also includes the intermediate larger portion 108 forming the first shoulder 110 with the reduced portion 106 and the large forward portion 112 forming the shoulder 114 with the intermediate portion 108. The ground contact 58, similar to that shown in connection with FIGS. 1-5, is positioned in the bore 104. The bushing 60 of the ground contact 58 is positioned against the first shoulder 110 with the rearward extending knife edge 64 extending into the central bore 22 of the base member 102 when the housing 144 and base member 142 are attached to each other.

An insulating ring 146 is positioned in the bore 104 with its forward end against the rear surface of the bushing 60 of the ground contact 58 and shoulder 114. A pin or probe member 68 like that shown in connection with the embodiment of FIGS. 1-5 is insert molded in the insulating ring 146 and includes a rearward extending needle-like projection 72 and a forward extending male probe member having a rounded tip portion 70. The needle-like projection 72 extends into the central bore 7 of the base member 142 when the base member 142 and housing 144 are connected.

A shell member 148 surrounds the insulating ring 146 and includes rearwardly extending split fingers 150 at its forward end as shown. The shell member includes a rearward outer cylindrical surface 152 and a circumferentially extending flange 154. An outer sleeve member 156 is positioned about the forward portion of the shell member and includes a bayonet slot 258 as is typical with such connectors for reception of the pin of a mating jack connector (not shown). In assembly, the rear outer surface 152 of the shell member is press fit into the rearward portion of the bore 102 of the housing member until the flange 154 abuts the forward end of the housing 144.

With this embodiment, as in the previous embodiments, when the housing 144 containing the BNC plug connector is threaded onto the base member 142, the two parts will be drawn toward each other and the needle-like projection of the pin member or probe 68 will be forced into the central signal wire or conductor 30 of a coaxial cable 10 and the rearward extending knife edge 64 of the ground contact 58 will engage the ground braid 40 of a cable to complete a good electrical connection.

With the arrangements shown, a two piece electrical connector is provided which enables a good connection of the coaxial cable to one portion of the connector with the ability for the user to inspect a forward end of the cable before the final connection takes place. When the housing containing the plug portion of the connector is threaded onto the base portion, by threading the members together until the housing abuts the shoulder on the base portion, one is assured of a good connection. While the drawings show a connector with RCA and BNC plugs, other embodiments of plugs may be used such as female RF and BNC plugs and F plugs, as well as various right angle plugs.

While various modifications have been shown and described, various modifications and substitutions may be made thereto. Accordingly, it is understood that the present embodiments have been described by way of illustration and not by limitation.

The invention claimed is:

1. An electronic connector for a coaxial cable comprising;

a base member having forward and rearward ends, a central bore extending there through and adapted to have a coaxial cable inserted into said bore from the rearward end thereof;

a stop in said bore for limiting the insertion of said cable into said bore;

means for securing a cable in said bore;

a housing having forward and rearward ends, a plug connector contained in said housing, said plug connector including a signal conductor having a needle like projection extending rearward and a ground contact insulated from said signal conductor and including a knife edge projection extending rearward; and means for advancing said housing and base member toward each other so that the needle-like projection and said knife edge projection extend into said bore of said base member rearward of said stop and securing said housing and base member together.

2. The electronic connector of claim 1 wherein said means for advancing includes said forward end of said base member being externally threaded and said housing having a threaded bore in its rearward end, whereby said housing can be threadably advanced onto said forward portion of said base member.

3. The electronic connector of claim 2 wherein said forward threaded portion of the base member is reduced with respect to said rearward portion forming a shoulder there between, said housing being threaded onto said base member until said rearward portion of said housing abuts said shoulder.

4. The electronic connector of claim 1 wherein said means for securing a cable within said base member comprises a screw member threaded into said base member and extending into said bore.

5. The electronic connector of claim 1 wherein said ground connection includes a bushing having a substantially circular knife edge projecting therefrom, said bushing being mounted in said housing.

6. The electronic connector of claim 1 including an insulating ring surrounding said signal conductor and a sleeve surrounding said insulating ring with a portion of the sleeve interposed between said housing and said insulating ring.

7. The electronic connector of claim 6 wherein said sleeve is conductive and includes a plurality of forwardly extending spring fingers.

8. The electronic connector of claim 7 wherein said sleeve comprises two mating half shells, each shell including tabs, and further including openings in said housing into which said tabs extend to secure said sleeve within said housing.

9. The electronic connector of claim 6 wherein said sleeve has a forward end and a rearward end, said rearward end of said sleeve being press fit into said forward end of said housing.

10. The electronic connector of claim 9 wherein said forward end of said sleeve has a member therein with radially inward extending spring protrusions thereon.

11. The electronic connector of claim 9 further including an outer sleeve member positioned about said sleeve, said outer sleeve having a bayonet slot therein.

12. A connector on a coaxial cable having a central signal conductor, an insulating layer around the signal conductor, a substantially tubular ground conductor around the insulating layer, and an insulating outer sheath, wherein the cable has a leading end with a clean transverse cut, comprising:

a base member having forward and rearward ends, a central bore extending between the forward and rearward ends, a stop in said bore adjacent said forward end, said coaxial cable being inserted through the rearward end such that the leading end of the cable confronts said stop at the forward end, said stop defining a predetermined limit position of the leading end of the inserted cable, and means securing the cable in the bore with the leading end at said position;

a housing having forward and rearward ends; and a plug connector contained in said housing, said plug connector including a signal conductor having a rearward extending needle-like projection and a ground contact insulated from said signal conductor and including a rearward extending knife edge projection, said forward end of said base member being attached to said rearward end of said housing with said needle-like projection axially penetrating the leading end of said coaxial cable in conductive contact with the signal conductor of said cable and said rearward extending knife edge projection coaxially penetrating the leading end of the cable between the sheath and the insulating layer and in conductive contact with the ground conductor of the cable.

13. The connector of claim 12 wherein said base member and said housing are threadably connected whereby as said housing is threaded on said base member, said base member is drawn toward said housing.

14. The connector of claim 12 wherein said means for securing said cable in said bore comprises a screw member threaded into said base member and extending into said bore.

15. The connector of claim 12 including an insulating ring surrounding said signal conductor and a sleeve surrounding said insulating ring with a portion thereof interposed between said housing and said insulating ring.

16. The connector of claim 15 wherein said sleeve is conductive and includes a plurality of forwardly extending spring fingers.

17. The connector of claim 15 wherein said sleeve has a forward end and a rearward end, said rearward end of said sleeve being press fit into said forward end of said housing.

18. The connector of claim 15 further including an outer sleeve member positioned about said sleeve, said outer sleeve having a bayonet slot therein.

19. A method of joining a connector to a coaxial cable having a central signal conductor, an insulating layer around the signal conductor, a substantially tubular ground conductor around the insulating layer, and an insulating outer sheath, comprising:

cutting the cable transversely to form a leading end having substantially coplanar central signal conductor, insulating layer, ground conductor, and sheath;

inserting the leading end of the cable into a base member to a stop that defines a predetermined limit position of the leading end relative to the base member and securing the cable within the base member at said limit position to form a first assembly;

providing a second assembly comprising a housing member, having a plug connector contained therein including a signal conductor mounted therein including a needle like projection extending rearward and a ground contact insulated from said signal conductor and including a knife edge projection extending rearward; and drawing the first and second assemblies coaxially toward each other to a fully assembled condition wherein the needle-like projection axially penetrates the leading end of the cable and establishes conductive contact with the signal conductor of the cable and the knife edge coaxially penetrates the leading end of the cable between the sheath and the insulating layer and establishes conductive contact with the ground conductor of the cable.

20. The method of claim 19 further comprising drawing the first and second assemblies together by threading one of said assemblies into the other of said assemblies.

* * * * *